United States Patent [19]

Beck et al.

[11] Patent Number: 5,009,667

[45] Date of Patent: Apr. 23, 1991

[54] COMPOSITION AND METHOD FOR PROVIDING STAIN RESISTANCE TO POLYAMIDE FIBERS USING CARBONATED SOLUTIONS

[75] Inventors: Boyd R. Beck, Spring City, Utah; Robert D. Harris, Cameron Park, Calif.

[73] Assignee: Harris Research Inc., Cameron Park, Calif.

[21] Appl. No.: 304,727

[22] Filed: Jan. 31, 1989

[51] Int. Cl.[5] ..... D06M 11/00

[52] U.S. Cl. ..... 8/115.56; 8/115.51; 8/115.6; 252/8.6; 252/8.7

[58] Field of Search ..... 252/8.7; 8/115.6, 115.56

[56] References Cited

U.S. PATENT DOCUMENTS

| | | | |
|---|---|---|---|
| 3,790,344 | 2/1974 | Frickenhaus et al. | 8/560 |
| 4,219,333 | 8/1980 | Harris | 8/137 |
| 4,501,591 | 2/1985 | Ucci et al. | 8/495 |
| 4,592,940 | 6/1986 | Blyth et al. | 252/8.7 |
| 4,619,853 | 10/1986 | Blyth et al. | 428/95 |
| 4,680,212 | 7/1987 | Blyth et al. | 428/97 |
| 4,681,790 | 7/1987 | Fong | 252/8.7 |
| 4,839,212 | 6/1989 | Blyth et al. | 428/96 |

*Primary Examiner*—A. Lionel Clingman

[57] ABSTRACT

Self neutralizing compositions and methods for their use are disclosed for treating polyamide fibers, such as nylon or wool carpeting, to render them stain resistant. The compositions are aqueous solutions carbonated to an appropriate acid pH containing one or more dye-resist agents which are condensation products of formaldehyde and a sulfonated naphthol or phenol. When the carbon dioxide escapes or evaporates subsequent to application, the pH rises to about neutral leaving the dye-resist agent ionically bonded to the polyamide fibers. An appropriate amount of a fluorochemical may also be contained in the solution which also physically interacts with the fibers and deters yellowing caused by the presence of the dye-resist agents. The process can be carried out during one or more cleaning, rinsing or subsequent finishing or protectant steps. In each step, the carbonated solution is applied under pressure at a pH of between about 2.5 and 7.0 and preferably between 3.5 and 6.5.

32 Claims, No Drawings

COMPOSITION AND METHOD FOR PROVIDING STAIN RESISTANCE TO POLYAMIDE FIBERS USING CARBONATED SOLUTIONS

BACKGROUND OF THE INVENTION

This invention relates to compositions and methods for imparting stain resistance to polyamide fibers using carbonated solutions containing dye-resist agents made up of condensation products of sulfonated phenols or naphthols and formaldehyde, with or without the presence of added fluorochemicals. More particularly, this invention relates to compositions and methods for (1) regenerating the stain resistant properties of previously treated polyamide fibers and (2) imparting stain resistant properties to polyamide fibers which have not been previously treated with stain resistant chemicals.

The term "stain resistant" as used in the industry means the ability of a polyamide fiber to resist staining when subjected to Food, Drug and Cosmetic Red Dye No. 40 (hereinafter called Red Dye 40). Fibers of polyamides (including natural polyamides such as wool and silk and synthetic polyamides most commonly referred to as nylons) may be woven into carpets and other textile materials which are long wearing and relatively inexpensive. They may be dyed into a variety of colors but tend to become permanently stained when subjected to most artificial colorants normally added to foods, beverages, medicines, cosmetics and the like, and also by chromophores found in most fruits and fruit based drinks, including wines. It is a well known fact that most nylon and wool carpeting is replaced because of staining and not because the carpet is worn.

It has been known for some time that polyamide fibers, which contain free amino groups, can be made stain resistant by applying sulfonated naphthol- or phenol-formaldehyde condensation products which react with the free amino groups forming an ionic bond. These sulfonated condensation products, commonly called "dye-resist agents", are well known in the art and are described in detail in U.S. Pat. Nos. 4,592,940; 4,501,591 and 4,699,812. Typical of these sulfonated naphtholic or phenolic condensation products are those available under the tradenames Wilnostain® (U.S. Polymeric), Erionol® NW and Erionol® PA (Ciba-Geigy), Intratex® N (Crompton and Knowles), and Misitol® NBS (Mobay). These and similar products have been sold for several years in the textile trade for use as dye-resist agents or agents to improve wetfastness and are recommended for use at an acidic pH of about 4 to 6. These dye-resist condensation products can be thought of as "colorless dyes" that bind to the free amino dye sites on polyamide fibers so that these sites are not available for reaction with dyes such as Red Dye 40, fruit stains, and similar materials.

The dye-resist products are normally applied to polyamide fabrics, such as carpeting, at the time they are manufactured but have not been well applied to installed carpets or fabrics subsequent to the manufacturing process. Two factors have been largely responsible in preventing the application of stain resistant chemicals to installed polyamide carpeting. The first factor is that, when improperly applied, these materials tend to yellow upon exposure to environmental conditions, such as the presence of $NO_2$, which is commonly found in the atmosphere. This causes obvious problems, especially on light dye shade fabrics. The second factor is that the normally high pH of cleaning solutions tends to prevent bonding of the stain resistant materials to the free amino groups of the polyamides and increases the yellowing tendency of these sulfonated condensation products.

Stain resistant carpets have been available only since about 1986 and are primarily made of one of the nylons, e.g. nylon 6 (polycaprolactam), nylon 66 (polyhexamethylene adipamide), nylon 11 (polymer of 11-amino undecanoic acid) and others. Carpets installed prior to that time are not stain resistant. It has been conventional practice to coat non-stain resistant fibers with a fluorochemical to prevent wetting of the fiber surface by both oils (hydrophobic) and aqueous (hydrophilic) solutions and minimize contact between the carpet and soiling materials. However, fluorochemicals offer little protection against staining unless the staining substance is immediately removed from the carpet before it has a chance to react with the polyamide fibers. The treatment of textiles with fluorochemical polymers is illustrated by U.S. Pat. Nos. 3,574,791; 3,728,151; 3,816,167; 3,916,053; 4,043,923; 4,043,964; 4,160,777; 4,192,754; 4,209,610; 4,264,484; 4,317,736; 4,604,316; 4,681,790 and 4,695,497. These fluorochemicals are commonly referred to under the tradenames Scotchgard® (Minnesota Mining and Manufacturing Co.), Teflon® (DuPont), Zonyl® (DuPont), Zepel® (DuPont), MPD 5737 and MPD 6202 (DuPont).

The durability of dye-resist agents and fluorochemicals on polyamide fibers varies greatly. Physical wearing caused by foot traffic on the carpet, abrasive action between fibers and sand or other particulate matter deposited on the carpet, and the like cause some removal of dye-resist agents even through they are chemically bonded to the fibers. Also fluorochemicals, which form a polymeric coating, are also removed over a period of time. Cleaning of the carpet with alkaline cleaning solutions also causes some chemical removal of dye-resist agents and fluorochemicals. Thus, over a period of time, carpets which once were treated to resist stains or resist oil and water solutions are made vulnerable to staining. Even more alarming is the vulnerability of carpet fibers which have never been treated to any type of dye-resist protection, even though they may have been previously treated with fluorochemicals.

It would therefore be desirable to provide a method for regenerating stain resistant polyamide fibers and making non-stain resistant polyamide fibers resistant to stains. However, as previously stated, there has heretofore been no convenient method for treating installed carpeting for such purposes. The dye-resist chemicals must be applied at an acid pH in order for the free amino groups on the polyamide fibers to become protonated and react with sulfonate anions of the dye-resist condensation products. Moreover, in order to have a truly stain resistant carpet, the free amino groups ($-NH_2$) of all fibers, from the nap to the base, must be protonated ($-NH_3^+$) and reacted with sulfonate ions ($-SO_3^-$). This is generally done by treating the fibers prior to being woven into a carpet or by submersing the carpet in an acid solution containing the dye-resist agents. The fibers or carpet made of fibers, as the case may be, may then also be immersed in a rinse or neutralizing solution to bring the pH to about neutral followed by drying. A neutral pH is important in that if the acid were to remain on the fibers it could, in the presence of moisture, result in the hydrolysis of the polyamide chain creating more free amino groups as new dye sites rendering the fiber non-stain resistant. The presence of acids can also cause gradual fading of some dyestuffs. Moreover, a neutral fiber is necessary for the safety of those who come into contact with the fibers.

If an acid solution of a dye-resist agent is applied to an installed carpet it is difficult to insure that the fibers are completely contacted by the solution to react with all dye binding sites. Also, it is difficult, if not impossible to rinse the fibers to a neutral pH. One way of doing this would be to subject the fibers to an alkaline treatment, with or without the presence of a detergent. However, any use of an alkaline agent immediately removes some of the dye-resist agent. Also, if the fibers have been treated simultaneously with a fluorochemical, some of the fluorochemical will be removed unless it has first been completely dried prior to the rinsing treatment.

OBJECTS AND SUMMARY OF THE INVENTION

It is an object of the present invention to provide a composition and method of treating polyamide fibers to render them stain resistant and also resistant to the yellowing associated with the presence of dye-resist agents.

It is also an object of the present invention to provide a composition and method for the treatment of polyamide fibers wherein the dye-resist agents can be applied in an appropriate acid environment using a solution which is self-neutralizing.

These and other objects may be carried out by formulating an aqueous solution containing appropriate amounts of one or more dye-resist agents, i.e. condensation products of formaldehyde and a sulfonated naphthol or phenol, carbonating the solution with carbon dioxide, preferably under pressure, to an appropriate pH and applying the carbonated solution to polyamide fibers. The carbon dioxide provides agitation to the solution with an effervescent type of action causing the solution to penetrate the entire fiber depth or length. Some mechanical assistance after the solution has been applied as an overspray, such as raking or brushing the fibers in a carpet or using a rotating buffing pad, may be desirable to ensure complete contact of the fiber with the solution. When the carbon dioxide escapes or evaporates, the pH rises to about neutral leaving the dye-resist agent ionically bonded to the polyamide fibers in the same manner as the acid dye coloring agents are bonded to the fiber. An appropriate amount of a fluorochemical may also be contained in the solution which also physically interacts with the fibers and deters yellowing which can be caused by the presence of the dye-resist agents.

In the present invention, the process of adding the dye-resist agent can be carried out during one or more cleaning, rinsing or subsequent finishing or protectant steps. The dye-resist agent can be added during the cleaning of the fiber in the presence of a suitable detergent because, unlike prior art alkaline cleaning methods, the presence of carbon dioxide lowers the pH to the appropriate range through the formation of carbonic acid. Subsequent to the cleaning step, a rinse is preferably applied to remove the detergent and the dye-resist agent may be applied during this step as a carbonated rinse solution. Finally, a carbonated protectant spray containing both a dye-resist agent and a fluorochemical may be used to finish the process. In each step, the carbonated solution is applied under pressure at a pH of between about 2.5 and 7.0 and preferably between 3.5 and 6.5. Thus, with each consecutive step using a carbonated solution, the bonding of the dye-resist agent to the polyamide fibers becomes more secure. Yet, at the same time, the evaporation of the carbon dioxide from the fibers is a self-neutralizing step wherein the final pH is near neutral rendering the treated fibers safe and non-toxic.

DETAILED DESCRIPTION OF THE INVENTION AND PREFERRED EMBODIMENTS

The present invention resides in the discovery that carbonated compositions containing state of the art dye-resist agents comprising condensation products of formaldehyde and one or more sulfonated phenols or naphthols provide stain resistance to polyamide fibers when applied to such fibers subsequent to their manufacture into commercial products and even after such fibers have been in use for their intended purpose. Additional advantages are obtained by including in the carbonated composition effective amounts of state of the art fluorochemicals used to provide oil, water and soil resistance. Particularly advantageous is the discovery that the carbonated compositions containing dye-resist condensation products, with or without added fluorochemicals, can be applied during or subsequent to the cleaning of polyamide fibers with detergents. The invention is not directed to novel dye-resist condensation products or fluorochemicals per se.

Dye-resist agents from the class of condensation products of formaldehyde and sulfonated phenols and/or naphthols are referenced in patents listed above which are incorporated herein by reference. Also trade literature and numerous other patents are also available listing these products. For purposes of definition herein they will simply be referred to as "dye-resist agents" or "stain-resist" agents by which they are commonly known.

Fluorochemicals useful for treating fibers to render them resistant to aqueous solutions, oils and soiling are also referenced in patents listed above which are incorporated herein by reference. As is the case with dye-resist agents, trade literature and numerous other patents are also available listing these products. For purposes of definition herein they will simply be referred to as "fluorochemicals" by which they are commonly known.

The use of carbon dioxide in detergent solutions for cleaning fabrics such as carpeting is disclosed in U.S. Pat. No. 4,219,333 issued to one of the coinventors herein. Certain of the detergents listed in this patent are suitable for use in the present invention. Anionic detergents are particularly preferred. The teachings contained in U.S. Pat. No. 4,219,333 regarding detergents, formulation and carbonation of solutions and the application of such carbonated solutions to fibers are incorporated herein by reference.

The present invention may be practiced to renew fibers which have previously been treated with dye-resist agents to restore the stain resistant quality to the fibers. On the other hand, the invention may be practiced to make previously non-stain resistant polyamide fibers resistant to stains.

It is desirable for the solution containing the dye-resist agent to contact the entire fiber body. When treating fibers which have previously been treated with dye-resist agents it is particularly important to treat the fibers near the top or nap since that is where the stain resistant properties will have been primarily removed.

When treating fibers which have not been treated with dye-resist agents it is imperative that the entire fiber length be subjected to treatment.

In describing the compositions of the invention the concentration of components will be referred to in terms of percent by weight (% w.), based on the total composition, unless otherwise stated. Broadly, the composition of the invention will be formulated to contain between about 0.0015 to 1.5% w. of a dye-resist agent, 0 to 6% w. of a fluorochemical (0.0015 to 6% is the range when the fluorochemical is present) and 0 to 5.0% w. of a detergent. The detergent, when present, may be in amounts conventionally used for the cleaning of fabrics such as carpets and will generally vary between about 0.1 to 5.0% w. While the remainder of the composition will preferably be water, other ingredients may be present provided they do not interfere with the ability of the dye-resist agents in the composition to react with free amino groups of the polyamide fibers. Such other ingredients can include agents commonly found in detergent compositions such as builder salts, optical brighteners, fragrances and the like. For purposes of the present invention such ingredients will simply be referred to as "inert" because, although they do have an active function in affecting the cleaning ability of the detergent solution, they do not prevent the dye-resist agents in the solution from reacting with the free amino groups on the polyamide fibers. The term "inert aqueous carrier" is inclusive of water plus "inert" ingredients. Hence, usage of the term "consisting essentially of" in the claims below is construed to means a composition containing the named ingredients plus other ingredients which do not affect the ability of the dye-resist agents from reacting as described above.

Preferably the composition will contain between about 0.06 to 0.6% w. of the dye-resist agent, 0 to 4.0% w. fluorochemical (0.6 to 4.0% w. is the range when the fluorochemical is present). Most preferred are compositions containing 0.25 to 0.5% w. dye-resist agent and 0 to 3.0% w. fluorochemical (2.0 to 3.0% w. is the range when the fluorochemical is present.

The compositions will be carbonated such that, at application, the pH will be in the broad range of about 2.5 to 7.0 with pH ranges of 3.5 to 6.5 being preferable and pH ranges of between about 4.0 to 6.3 being most preferable. Generally, the solution will be carbonated by being pressurized with gaseous carbon dioxide and will be applied to the fabric under a pressure of between about 1 to 10 atmospheres (gauge pressure of about 15 to 150 psig). Pressure is not critical provided the pH is within the stated ranges and the carbonated solution is adequately and uniformly dispensed onto the fibers being treated. Application pressures of 2 to 8 atmospheres (about 29 to 120 psig) are preferred with pressures of between about 3 to 6 atmospheres (44 to 88 psig) being most preferred. When a fluorochemical is present, the ratio of fluorochemical to dye-resist agent will be between about 1:1 to 16:1 with ratios of between 4:1 and 12:1 being preferred and ratios of between about 6:1 to 10:1 being most preferred.

The aqueous carbonated solution is preferably applied to the fibers as a spray from a pressurized vessel which has been uniformly carbonated by the introduction of gaseous carbon dioxide to an appropriate pressure accompanied or followed by shaking or other means of agitation to provide a uniformly carbonated solution. The carbonated solution, when applied to fibers, such as a carpet, rapidly breaks into myriad tiny effervescent particles which rapidly penetrate throughout the fibers bringing the dye-resist agent (and also detergent and fluorochemical when present) into contact with the fiber. However, to make sure that maximum contact is had between the fibers and the solution, particularly when treating carpeting, it is desirable to provide some mechanical action, such as brushing, raking, or buffing with a rotating pad immediately after application of the solution. This should be done in more than one direction to provide maximum contact. The pH at which the solution contacts the fibers is sufficiently low to protonate the free amino groups of the fibers which, in turn, attract and ionically bond the negatively charged sulfonate radicals of the dye-resist agents. The application process should be continued for a time sufficient to allow all fiber surfaces to be contacted and wetted by the solution.

When released onto the carpet or other polyamide fiber substrate, the carbon dioxide evaporates into the atmosphere providing self-neutralization of the solution in contact with the fibers in a safe, odorless, non-toxic manner but not before the dye resist agents have been bonded to the dye sites on the fiber. Carbonation is also believed to be important in allowing the fluorochemicals, when present, to function to reduce undesired yellowing caused by the presence of the dye-resist agents. While not wishing to be bound by any particular theory, it is believed that the fluorochemical protects the dye-resist agents from becoming exposed to atmospheric yellowing agents such as $NO_2$. Moreover, yellowing has been found to increase as the pH of the solution is increased. Therefore, the presence of carbon dioxide functions to keep the pH as an appropriately low level to maximize bonding of the dye-resist agents to the dye sites on the fibers and maximize the effectiveness of the fluorochemical in preventing yellowing in the treated fibers.

While the invention is generally applicable to treating any polyamide fiber substrates, carpeting is the preferred substrate. Both wool and nylon carpeting may be treated. The invention is especially applicable to the treatment of nylon fibers such as nylon 66 and nylon 6.

Optimal stain resistant results are obtained by contacting the polyamide fibers with carbonated solutions containing between about 0.01 to 0.05% w. of dye-resist agent based on the weight of the fiber. Ranges between about 0.005 to 2% w. of dye-resist agent are deemed to be operable. The amount to be used will obviously be based on a number of variables such as whether the dye-resist agent is contained in a detergent, rinse or finishing solution and whether the fibers being treated are being renewed or treated for the first time.

The inclusion of the dye-resist agent in a detergent solution enables the dye-resist to immediately contact the cleaned fibers. However, in the presence of detergents, builder salts and the like, a buffering effect may be obtained in the carbonated solution which will not allow the pH to drop as low as would otherwise be desirable to optimize the dye site binding reaction. In certain instances, a dye-resist agent may be added to an uncarbonated detergent solution use to clean carpet fibers. This is primarily a pre-treatment procedure and will not effectively cause a reaction between all the free amino groups of the polyamide fibers and the sulfonate radicals of the dye-resist agents because the pH of uncarbonated detergents solutions will generally be higher than the isoelectric point of the free amino groups on the fibers leaving them in an unprotonated form. Some reaction between dye-resist agents and dye binding sites on these fibers will occur at these higher pH ranges but only a minor portion of the dye binding sites will be blocked from staining. At a pH above the isoelectric point, the chance of unbinding or reverse reaction of the dye-resist agents may also occur.

Whether or not a dye-resist agent is added to the cleaning solution, it is considered preferable to add a dye-resist agent to the rinse solution used to remove detergent from the fibers in a cleaning process. The carbonation of the rinse solution allows the dye-resist agent to be applied at a lower pH. Moreover, since the rinse is applied subsequent to the cleaning step less dye-resist agent is removed.

In both the cleaning and rinsing steps the solutions are physically or mechanically removed by appropriate means such as by absorption onto pads, suctioning and the like. Since the solutions are removed it is generally not preferred to add a fluorochemical to these solutions because the fluorochemical needs to dry on the fiber to function effectively. However, that is not to say one could not add a fluorochemical to either of these steps if desired.

Once the fibers are cleaned and rinsed, as described above, they are most susceptible to treatment with dye-resist agents and also the protective properties provided by the fluorochemicals. Therefore, the final, finishing or protectant step becomes one of primary importance in rendering polyamide fibers stain resistant. If one or more previous steps have contained dye-resist agents the final protective step serves to insure that the remainder of the dye-binding free amino sites on the fibers become reacted with the dye-resist agents. If neither the cleaning or rinsing steps contained dye-resist agents, this step becomes the sole process for providing stain resistance. Hence, it is imperative that the finishing or protectant solution be applied at a pH between about 3.5 and 6.5 to enable optimal reaction of the dye-resist agents with the dye binding protonated amino groups. This is where carbonation of the solution becomes effective in providing the proper pH with subsequent self-neutralization. Once the carbonated protectant solution containing both the dye-resist agent and fluorochemical has been applied as an overspray, it is raked or brushed into the carpet fibers for maximum penetration and contact and then allowed to dry.

When utilizing carbonated solutions the solution will usually be applied at ambient temperatures. The higher the temperature the greater will be the penetration of the dye resist into the fiber. However, it is difficult to maintain a satisfactory degree of carbonation at elevated temperatures. While the low temperature application of the dye-resist to installed carpeting in the present invention may not provide the same degree of penetration that is obtained by immersing the carpet in high temperature baths as is done in a mill, the application of carbonated solutions is sufficient to replace lost stain-resists and provide good stain-resistance to non-stain-resistant carpet.

The following procedures describe the preferred embodiment of the invention.

CLEANING AND APPLICATION PROCEDURE

When a stain-resist material is applied to installed carpet a three step procedure is normally involved. In step one (cleaning step) the carpet is cleaned with a cleaning solution which can contain dye-resist agents and which is preferably carbonated and sprayed onto the carpet. This cleaning solution is then contacted with a rotating cloth pad to absorb the dirt and solution. In step two (rinsing step), the same procedure is followed with the rinse preferably being carbonated and containing a dye-resist agent. The rinse and residual detergent are then removed by buffing with an absorbent pad. In step three (finishing or protectant step), a solution containing a dye-resist agent and/or a fluorochemical is carbonated and sprayed onto the carpet. This solution is brushed or raked into the carpet and the carpet is allowed to dry.

In order to produce a consistent cleaning cycle, 3.5×7 inch samples of white nylon carpet were sprayed with 3.2 ml of a cleaning solution and rubbed in a back and forth motion (10 times in each direction) with a white terry cloth that had been dampened with 2 ml of water and that was attached to a rubber sanding block (2.5×4.47 inches). Because of the smallness of the carpet samples this procedure was used in lieu of a rotating absorbent pad.

A 3.2 ml sample of rinse was then applied and rubbed in a back and forth motion (10 times in each direction) with a white terry cloth as before.

The finishing or protectant treatment consisted of spraying 3.2 ml of treatment onto the carpet, brushing it three times in each direction, and allowing it to dry.

CLEANING, RINSING AND PROTECTANT SOLUTIONS

Cleaning Solution No. 1: 36 grams of Formula V (Harris Research, Inc.) proprietary anionic detergent per gallon of water having a pH of 9.2.

Cleaning Solution No. 2: Cleaning Solution No. 1 carbonated with $CO_2$ to a pressure of 60 psi. The pH of the solution as it contacted the carpet was determined to be 6.2.

Cleaning Solution No. 3: Cleaning Solution No. 1 also containing 30 g/gallon Erional® NW (Ciba-Geigy) dye-resist agent having a pH of 9.2.

Cleaning Solution No. 4: Cleaning Solution No. 3 carbonated to a pH of 6.2.

Rinsing Solution No. 1: tap water.

Rinsing Solution No. 2: tap water carbonated to a pH of 3.9.

Rinsing Solution No. 3: tap water containing 30 g/gallon of Erional® NW (Ciba Giegy) dye-resist agent carbonated to a pH of <5.5.

Protectant Solution No. 1: 30 grams of Erional® NW (Ciba Giegy) dye-resist agent per gallon of water.

Protectant Solution No. 2: Protectant Solution No. 1 carbonated with $CO_2$ to a pressure of 60 psi. The pH of the solution as it contacted the carpet was determined to be <5.5.

Protectant Solution No. 3: 30 grams of Erional® NW (Ciba Giegy) dye-resist agent, and 240 grams of Teflon® MF (fluorochemical) per gallon of water.

Protectant Solution No. 4: Protectant Solution No. 4 carbonated to a pH of <5.5.

Protectant Solution No. 5: 60 grams of Erional® NW (Ciba Giegy) dye-resist agent, and 240 grams of Teflon® MF (fluorochemical).

Protectant Solution No. 6: Protectant Solution No. 6 carbonated to a pH of <5.5.

TEST METHODS

The test for yellowing was conducted by exposing samples to 30 days of south exposure sunlight and comparing by visual examination with an untreated control sample.

Differences in stain resistance was determined as follows: The standard staining material used was a commercially available cherry flavored sugar sweetened beverage powder dissolved in water to provide a solution containing 0.1 g/liter FD&C Red No. 40. One ounce of this material was poured through a 1.5 inch diameter tube from a height of 14 inches onto the nylon carpet and allowed to dry for 24 hours. Each nylon carpet sample was then rinsed with cold running water and dried by shaking off as much water as possible and placed under ¼ inch of paper towels and a book as weight. After drying for 24 hours the amount of staining remaining on the carpet sample was determined by visual comparison.

EXAMPLE 1

A white sample of Anso V Worry Free (nylon 6) (Allied Corporation) carpet was cut into 3.5×7 inch test strips and treated with the following solutions according to the procedures described above:

| Sample | Solutions | | |
|---|---|---|---|
| | Cleaning | Rinsing | Protectant |
| A | 1 | 1 | — |
| B | 2 | 2 | — |
| C | 3 | 1 | — |
| D | 4 | 2 | — |
| E | 2 | 3 | — |
| F | 2 | 2 | 1 |
| G | 2 | 2 | 2 |
| H | 2 | 2 | 3 |
| I | 2 | 2 | 4 |

The staining tests clearly demonstrate the advantages of the present invention. Test Samples A, B, C, D, and E are directly comparable with Samples D and E falling within the scope of the invention. In Test Sample D the dye-resist agent is in the carbonated detergent solution and in Test Sample E the dye-resist agent is in the carbonated rinse solution. The carpet samples tested were from a new stain-resistant carpet and hence no staining was evident on the control. This example really tests the ability to renew stain-resistant properties lost during the cleaning of the carpet. Sample E showed no detectable staining, Samples D and C were a light pink and Samples B and A showed noticeable pink to light red staining. Ranked in order of least to most perceptible staining the samples are E<D<C<B<A. This shows that the carbonated dye-resist agent in the rinse solution (Sample E) provided more stain resistance than placing the dye-resist agent in the carbonated detergent solution (Sample D) at the same concentration. However, carbonating the detergent solution containing a dye-resist agent and also carbonating the rinse water (Sample D) provided better stain resistance than merely placing the dye-resist agent in the detergent without carbonation (Sample C). Sample C, containing a dye-resist agent, provides some stain resistance as compared to Samples B and A. However, carbonating the detergent solution (Sample B) to an acid pH removes less dye-resist agent than using a non-carbonated detergent solution (Sample A).

In terms of yellowing, there is no fluorochemical present in Test Samples A–E. However, Samples A and B, which contained no new added dye-resist agent, showed less yellowing overall. Samples D and E, wherein the dye-resist agent was applied under carbonation showed less yellowing than Sample C, wherein the dye-resist agent was applied without carbonation. The ranking from least to most yellowing in Samples A–E was B=A<D<E<C.

Test Sample G is comparable to Test Sample F, differing only in carbonation of the protectant solution containing a dye-resist agent. In terms of stain resistance, Test G was determined to be slightly better than Test F although the stain was barely perceptible. There was less yellowing shown in Test G than in Test F.

Test Sample I is comparable to Test Sample H differing only in the carbonation of Test Sample H. Both protectant solutions contained both dye-resist agents and fluorochemicals. The stains in these tests were also barely perceptible although Test I was determined to show less stain than Test G. Test I, containing the fluorochemical, showed less yellowing than Test G.

EXAMPLE 2

A white Stainmaster (nylon 66) (DuPont) carpet was submitted to the same cleaning and treatments as in Example 1 with the same results being observed except that even less staining was observed in all samples than in Example 1. Essentially the same general results were observe regarding yellowing.

EXAMPLE 3

A white Silver Label (nylon 66) (Monsanto Co.) carpet was tested as in Example 1. Essentially the same staining and yellowing results were obtained as in Example 2.

EXAMPLE 4

A white Gold Label (nylon 66) (Monsanto Co.) carpet was tested as in Example 1. The yellowing results were the same but no detectable staining occurred on any of the samples.

EXAMPLE 5

A white Anso X (nylon 6) (Allied Corporation) carpet (non-stain-resistant) was submitted to the following tests:

| Sample | Solutions | | |
|---|---|---|---|
| | Cleaning | Rinsing | Protectant |
| J | 2 | 2 | — |
| K | 3 | 1 | — |
| L | 4 | 2 | — |
| M | 2 | 3 | — |
| N | — | — | 1 |
| O | — | — | 2 |
| P | — | — | 3 |
| Q | — | — | 4 |
| R | — | — | 5 |
| S | — | — | 6 |

As in Example 1, the staining tests clearly demonstrate the advantages of the present invention. Test Samples J, K, L, and M are directly comparable with Samples L and M falling within the scope of the invention. In Test Sample M the dye-resist agent is in the carbonated detergent solution and in Test Sample L the dye-resist agent is in the carbonated rinse solution. The carpet samples tested were from a new non-stain-resistant carpet and the control was dyed to a bright red color when stained. This example tests the ability to provide stain-resistant properties to non-stain resistant carpeting. Sample M showed a light pink stain, Samples L show a more perceptible pink stain and Sample K exhibited a still darker pink. Samples J showed bright red stain. Ranked in order of least to most perceptible staining the samples are M<L<K<J. This corroborates Example 1 in showing that the carbonated dye-resist agent in the rinse solution (Sample M) provided more stain resistance than placing the dye-resist agent in the carbonated detergent solution (Sample L) at the same concentration both in renewing and creating stain resistant properties. However, carbonating the detergent solution containing a dye-resist agent and also carbonating the rinse water (Sample L) provided better stain resistance than merely placing the dye-resist agent in the detergent without carbonation (Sample K). Sample K, containing a dye-resist agent, provides some stain resistance as compared to Sample J.

In terms of yellowing, the results are again comparable to Example 1. There is no fluorochemical present in Test Samples J-M. However, Sample J, which contained no new added dye-resist agent, showed less yellowing overall. Samples L and M, wherein the dye-resist agent was applied under carbonation showed less yellowing than Sample K, wherein the dye-resist agent was applied without carbonation. The ranking from least to most yellowing in Samples J-M was J<L<-M<K.

Test Samples N, O, P and Q are directly comparable with Samples O and Q falling within the scope of the invention. Test Sample O contains a dye-resist agent in a carbonated protectant solution and Test Sample N is the uncarbonated equivalent. Test Sample Q differs from Sample O in having a fluorochemical added to the protectant solution and Test Sample P is the uncarbonated equivalent. In terms of imparting stain resistance to previously non-resistant fibers, Sample Q was superior showing almost no staining at the fiber tips and only light staining at the base of the pile. Sample N showed the most staining, the tips were a light pink but there was a darker staining at the base of the pile. In order of imparting stain resistance the samples were ranked in the order of Q<O<P<N. However, in terms of yellowing the rankings from least to most yellowing was Q<P<O<N showing that the presence of the fluorocarbon is more important in preventing yellowing than the presence of carbon dioxide. However, when both are present optimal results are obtained.

In Samples R and S more dye-resist agent was used than in Samples P and Q. Otherwise the protectant solutions were the same. The results were comparable with less staining being shown in Sample S than in Sample R. Almost complete stain resistance was shown except for a light pink at the very base of the pile. In terms of yellowing, Sample S showed slightly less yellowing than in Sample R.

EXAMPLE 6

A white sample of Antron (nylon 66) carpet was submitted to the same tests described in Example 5. The yellowing results were the same as those described in Example 5, but the staining tests showed less staining in all samples.

EXAMPLE 7

A 2.5'×4.5' sample of white Anso V Worry Free (nylon 6) carpet was divided in half and cleaned and treated as follows:

Side Y: Cleaning Solution No. 1, Rinsing Solution No. 1 and Protectant Solution No. 3.

Side Z: Cleaning Solution No. 2, Rinsing Solution No. 2 and Protectant Solution No. 4.

The cleaning, rinsing and protectant solutions were all applied at a rate of approximately 1 gallon per 200 sq. ft.

The entire sample was submitted to 5000 foot traffics and was vacuumed 100 times the long way in both directions. Staining tests revealed that Side Y (cleaned, rinsed and protected without carbonated solutions) stained considerably more than Side Z (cleaned, rinsed and protected with the same solutions which had been carbonated).

The above examples demonstrate the preferred embodiments of the invention as presently known. Based on the above disclosure, various modifications, such as using other dye-resist agents, fluorochemicals, application procedures, and the like will be obvious to those skilled in the art. The invention is therefore to be limited only in scope by the following claims and functional equivalents thereof.

We claim:

1. An aqueous carbonated composition for treating polyamide fibers to impart stain resistance to said fibers consisting essentially of (a) between about 0.0015 to 1.5% w. of a dye-resist agent consisting of a condensation product of formaldehyde and a member selected from the group consisting of a sulfonated phenol or a sulfonated naphthol; (b) 0 to 6.0% w. of a fluorochemical; and (c) 0 to 5% w. of a detergent suitable for cleaning polyamide fibers with the remainder being made up of an inert aqueous carrier; said aqueous composition being maintained at a pH of between about 2.5 and 7.0 be means of said carbonation.

2. A carbonated composition according to claim 1 wherein the solution is maintained under a pressure of between about 1 to 10 atmospheres.

3. A carbonated composition according to claim 1 wherein the detergent is present in amounts ranging between about 0.1 to 5.0% w.

4. A carbonated composition according to claim 1 wherein the fluorochemical is present in amounts ranging between about 0.0015 and 6% w.

5. A carbonated composition according to claim 4 wherein the ratio of fluorochemical to dye-resist agent is between about 1:1 and 16:1.

6. A carbonated composition according to claim 5 wherein the dye-resist agent is present in amounts between about 0.06 and 0.6% w. and the fluorochemical is present in amounts ranging between about 0.6 to 4.0% w.

7. A carbonated composition according to claim 6 wherein the pH is maintained between about 3.5 and 6.5.

8. A carbonated composition according to claim 7 wherein the ratio of fluorochemical to dye-resist agent is between about 4:1 and 12:1.

9. A carbonated composition according to claim 8 wherein the dye-resist agent is present in amounts between about 0.25 and 0.5% w. and the fluorochemical is present in amounts ranging between about 2.0 to 3.0% w.

10. A carbonated composition according to claim 9 wherein the pH is maintained between about 4.0 and 6.3.

11. A method of imparting stain resistance to polyamide fibers having free amino groups which comprises applying to said polyamide fibers an effective amount of an aqueous carbonated solution consisting essentially of (a) between about 0.0015 to 1.5% w. of a dye-resist agent consisting of a condensation product of formaldehyde and a member selected from the group consisting of a sulfonated phenol or a sulfonated naphthol; (b) 0 to 6.0% w. of a fluorochemical; and (c) 0 to 5% w. of a detergent suitable for cleaning polyamide fibers with the remainder being made up of an inert aqueous carrier; said aqueous composition being maintained at a pH of between about 2.5 and 7.0 by means of said carbonation whereby said dye-resist agent is caused to react with said free amino groups on said fibers rendering said amino groups unavailable for reaction with dyes.

12. A method according to claim 11 wherein the carbonated solution is maintained under a pressure of between about 1 to 10 atmospheres.

13. A method according to claim 12 wherein the polyamide fibers being treated is carpeting.

14. A method according to claim 13 wherein a detergent is present in the carbonated solution in amounts ranging between about 0.1 to 5.0% w.

15. A method according to claim 14 wherein the carpeting is subject to a series of treatment steps using a carbonated detergent solution, a carbonated rinse solution and a carbonated protectant solution comprising:

(a) first applying to the polyamide fibers, as a spray, an effective amount of the carbonated detergent solution of claim 14 and mechanically working said solution into said polyamide fibers;

(b) next applying to said polyamide fibers, as a spray, a carbonated aqueous rinse solution containing from 0 to 1.5% w. of said dye-resist agent at a pH of between about 3.5 and 6.5 and mechanically removing at least a portion of said carbonated detergent solution and rinse solution from said fibers; and (c) finally applying to said polyamide fibers, as a spray, an effective amount of a carbonated protectant solution consisting essentially of (a) 0.0015 to 1.5% w. of said dye resist agent and (b) 0.0015 to 6.0% w. of said fluorochemical at a pH of between about 3.5 and 6.5 and mechanically working said solution into said fibers.

16. A method according to claim 15 wherein the ratio of fluorochemical to dye-resist agent in the carbonated protectant solution is between about 1:1 and 16:1.

17. A method according to claim 16 wherein the dye-resist agent is present in the carbonated protectant solution in amounts between about 0.06 and 0.6% w. and the fluorochemical is present in amounts ranging between about 0.6 to 4.0% w.

18. A method according to claim 17 wherein the ratio of fluorochemical to dye-resist agent in the carbonated protectant solution is between about 4:1 and 12:1.

19. A method according to claim 18 wherein the dye-resist agent is present in the carbonated protectant solution in amounts between about 0.25 and 0.5% w. and the fluorochemical is present in amounts ranging between about 2.0 to 3.0% w.

20. A method according to claim 19 wherein the pH of the carbonated protectant solution is maintained between about 4.0 and 6.3.

21. A method according to claim 13 wherein no detergent is present and wherein said fluorochemical is present in the carbonated solution in amounts ranging between about 0.0015 to 6.0% w.

22. A method according to claim 21 wherein the ratio of fluorochemical to dye-resist agent is between about 1:1 and 16:1.

23. A method according to claim 22 wherein the dye-resist agent is present in amounts between about 0.06 and 0.6% w. and the fluorochemical is present in amounts ranging between about 0.6 to 4.0% w.

24. A method according to claim 23 wherein the ratio of fluorochemical to dye-resist agent is between about 4:1 and 12:1.

25. A method according to claim 24 wherein the dye-resist agent is present in amounts between about 0.25 and 0.5% w. and the fluorochemical is present in amounts ranging between about 2.0 to 3.0% w.

26. A method according to claim 25 wherein the pH is maintained between about 4.0 and 6.3.

27. A method of imparting stain resistance to carpeting consisting of polyamide fibers having free amino groups which comprises subjecting said polyamide fibers, subsequent to cleaning with a detergent solution, to a series of treatment steps using a carbonated rinse solution and a carbonated protectant solution comprising:

(a) first applying to said polyamide fibers, as a spray, a carbonated aqueous rinse solution containing from 0.015 to 1.5% w. of a dye-resist agent consisting of a condensation product of formaldehyde and a member selected from the group consisting of a sulfonated phenol or a sulfonated naphthol at a pH of between about 3.5 and 6.5, allowing said dye-resist agent to react with the free amino groups on said fibers rendering said amino groups unavailable for reaction with dyes and mechanically removing at least a portion of said carbonated rinse solution and residual detergent from said fibers; and (b) next applying to said polyamide fibers, as a spray, an effective amount of a carbonated protectant solution consisting essentially of (a) 0.0015 to 1.5% w. of said dye-resist agent and (b) 0.0015 to 6.0% w. of a fluorochemical at a pH of between about 3.5 and 6.5, allowing the dye-resist agent to react with remaining free amino groups on said fibers rendering said amino groups unavailable for reaction with dyes and mechanically working said solution into said fibers.

28. A method according to claim 27 wherein the ratio of fluorochemical to dye-resist agent in the carbonated protectant solution is between about 1:1 and 16:1.

29. A method according to claim 28 wherein the dye-resist agent is present in the carbonated protectant solution in amounts between about 0.06 and 0.6% w. and the fluorochemical is present in amounts ranging between about 0.6 to 4.0% w.

30. A method according to claim 29 wherein the ratio of fluorochemical to dye-resist agent in the carbonated protectant solution is between about 4:1 and 12:1.

31. A method according to claim 30 wherein the dye-resist agent is present in the carbonated protectant solution in amounts between about 0.25 and 0.5% w. and the fluorochemical is present in amounts ranging between about 2.0 to 3.0% w.

32. A method according to claim 31 wherein the pH of the carbonated protectant solution is maintained between about 4.0 and 6.3.

* * * * *